US006676206B2

(12) United States Patent
Brandschain

(10) Patent No.: US 6,676,206 B2
(45) Date of Patent: Jan. 13, 2004

(54) ROCKING, RECLINING, FOLDING CHAIR

(76) Inventor: Daniel B. Brandschain, 417 Revere Rd., Lafayette Hill, PA (US) 19444

( * ) Notice: Subject to any disclaimer, the term of this patent is extended or adjusted under 35 U.S.C. 154(b) by 0 days.

(21) Appl. No.: 10/150,645

(22) Filed: May 16, 2002

(65) Prior Publication Data

US 2003/0214159 A1 Nov. 20, 2003

(51) Int. Cl.[7] ..... A47C 3/02

(52) U.S. Cl. ..... 297/32; 297/259.2; 297/260.3; 297/271.4; 297/82

(58) Field of Search ..... 297/32, 16.1, 29, 297/30, 310, 38, 39, 40, 41, 46, 82, 258.1, 259.2, 260.3, 270.1, 270.5, 271.4, 259.1, 271.1

(56) References Cited

U.S. PATENT DOCUMENTS 444,992 A * 1/1891 Pohl
514,445 A * 2/1894 Cornell
1,711,371 A * 4/1929 Zentmyer
1,860,867 A * 5/1932 Matthews
1,889,646 A * 11/1932 Ernst
2,710,645 A * 6/1955 Luckhardt
2,715,937 A * 8/1955 Thomas
4,092,041 A * 5/1978 Landry et al.

* cited by examiner

*Primary Examiner*—Laurie K. Cranmer
(74) *Attorney, Agent, or Firm*—Scott J. Fields, Esq.; National IP Rights Center, LLC

(57) ABSTRACT

A rocking, reclining, foldable chair is disclosed. The invention comprises a curved rocker or rockers having a limiting extension; a leg or legs pivotally attached to said rocker; a seat pivotally attached to said leg or legs; a releasable support pivotally attached to any two of the aforesaid parts to prevent said chair from folding unexpectedly; a back pivotally attached to said seat or leg or legs; a pair of arms movably connected to said back; and a leg rest pivotally attached to said seat and said arms, said leg rest being movable between a rocking and a reclining position; and moving means for moving said leg rest, said back and said seat between said rocking and said reclining position.

2 Claims, 3 Drawing Sheets

ROCKING, RECLINING, FOLDING CHAIR

FIELD OF THE INVENTION

The present invention relates to chairs and, more particularly, to a rocking chair that can be positioned as a reclining chair and is capable of being folded for transportation and storage.

BACKGROUND OF THE INVENTION

There are chairs that rock, chairs that recline, chairs that rock and recline, and even versions of rockers and recliners that can be folded for transportation and storage. However, until this invention, there have not been any chairs that accomplish all three tasks: rock, recline and fold. The combination rocker/recliners heretofore available utilize complex unsightly mechanisms and heavy, cumbersome support structures to make them work safely. Such chairs require unattractive upholstery to hide the said mechanisms. Additionally, some of these chairs move from one position to the other with a rapid, unnatural action; some often feel as if they will topple over; some require great effort to move from one position to the other position; many require getting out of the chair to manipulate its mechanism from one position to the other; and most require greater effort than many senior citizens are capable of exerting just to get out of the chair.

SUMMARY OF THE INVENTION

A rocking, reclining, foldable chair, comprising: a curved rocker having a straight or reverse curved extension; leg(s) pivotally attached to said rocker; a seat pivotally attached to said leg(s); a back pivotally attached to said seat or leg(s); arms movably connected to said back; a leg rest pivotally connected to said seat and arms via said arms to said back; locking support means to hold the chair folded for transportation and/or storage and unfolded for use; and additional locking support means to hold the chair in its rocking position when locked and in its reclining positions when unlocked.

In a more preferred embodiment, the moving means includes arms; a leg rest; slots in either said arms or said leg rest; and pins attached to the upper end of each leg rest or to the arms engaging said slots such that said pins are located at the first end of the slots when the chair is in the rocking position, said pins being located at the second end of the said slots when said chair is in the reclining position, whereby said pins move from one end of said slots to the other end of said slots when a user pulls up on said arms and shifts their weight backward in said chair thereby moving said leg rest, said seat and said back from said rocking position to said reclining position and whereby a user can return to the rocking position merely by shifting his or her weight forward which reverses the process and allows the arms to drop and the pins to lock at the first end of the slots.

In a further embodiment, the invention is a method for a person sitting in a chair to go from an erect rocking position to a reclining position and back to the rocking position by shifting his or her weight, comprising the steps of (a) providing a chair which can rock and recline; and (b) balancing the lengths of the components of the chair and the angles that the components bear to each other whereby, the user can move virtually effortlessly from the rocking position to the reclining position and back to the rocking position by changing the combined center of gravity of the user and the chair merely by shifting his or her weight by leaning backward or forward.

BRIEF DESCRIPTION OF THE DRAWINGS

For a better understanding of the present invention, reference is made to the following detailed description of an exemplary embodiment considered in conjunction with the attached drawings, in which.

DETAILED DESCRIPTION OF THE INVENTION

Figure 1:
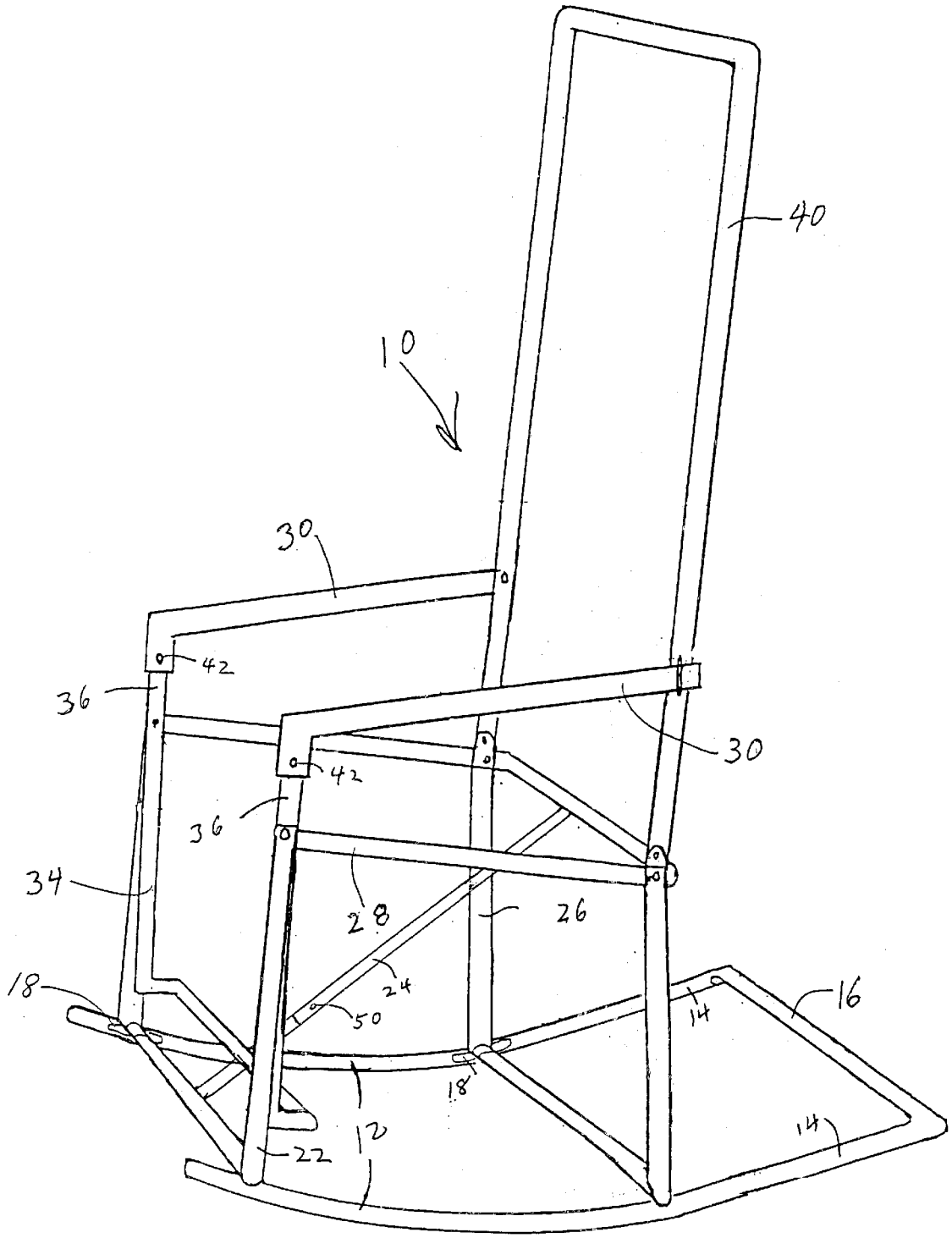
FIG. 1 is a perspective view of an embodiment of a chair constructed in accordance with the present invention shown in a rocking position.
Figure 2:
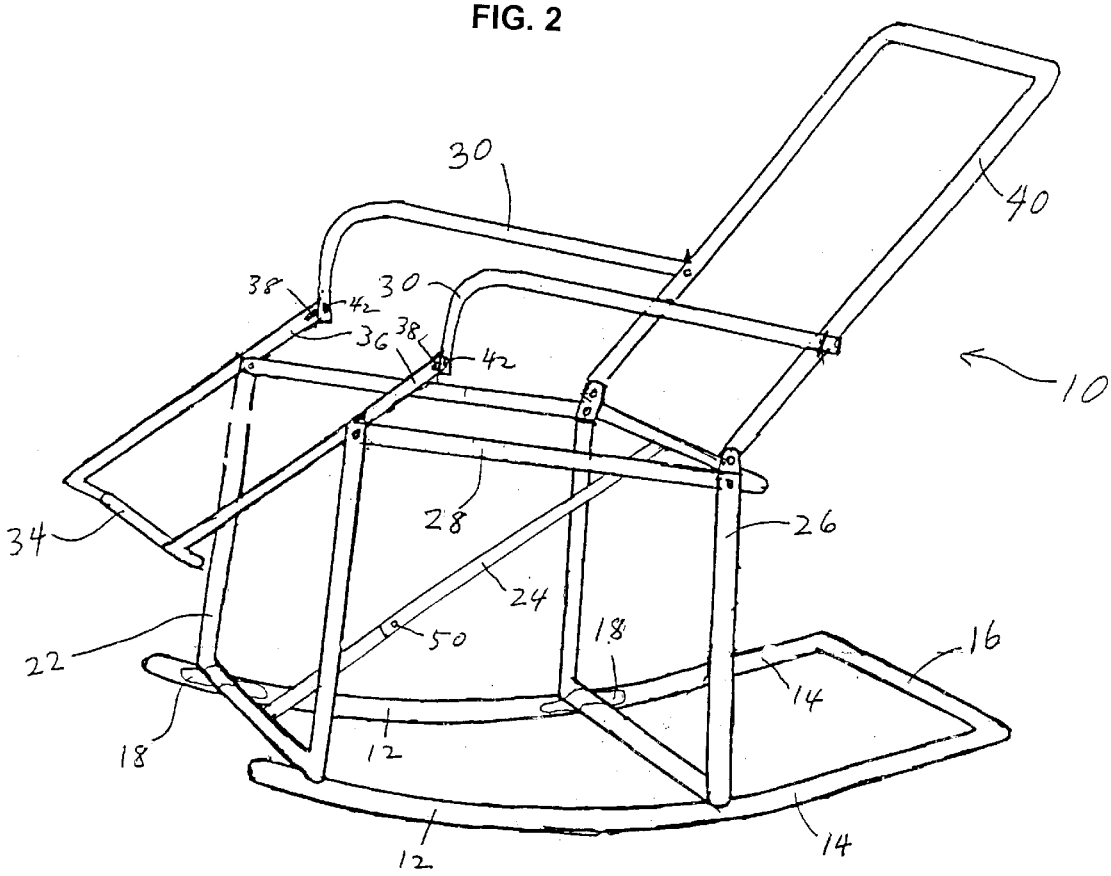
FIG. 2 is a perspective view of the chair shown in FIG. 1 in a reclining position.
Figure 3:
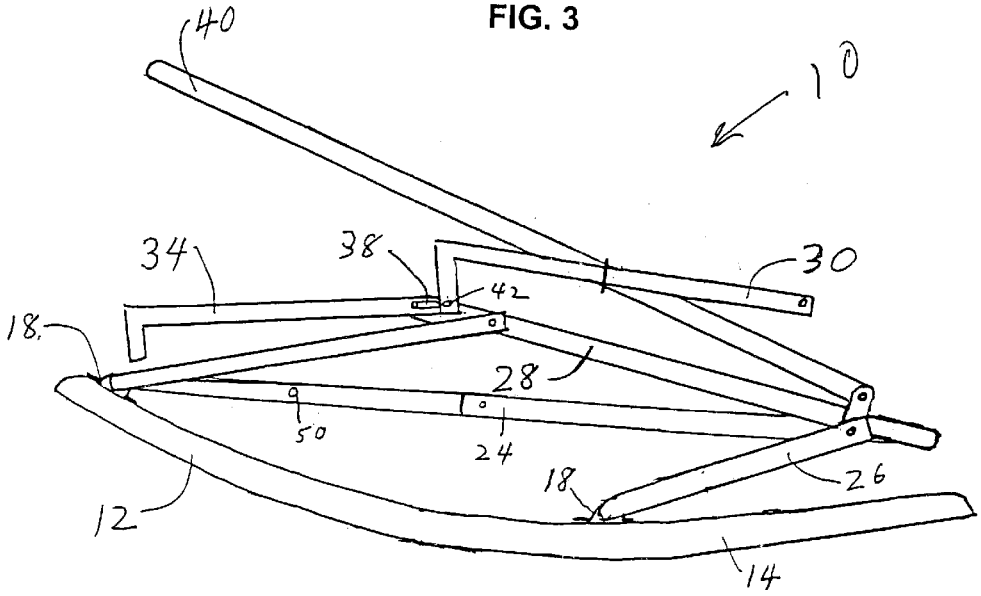
FIG. 3 is a side view of the chair shown in FIG. 1 in a folded position.
Figure 5:
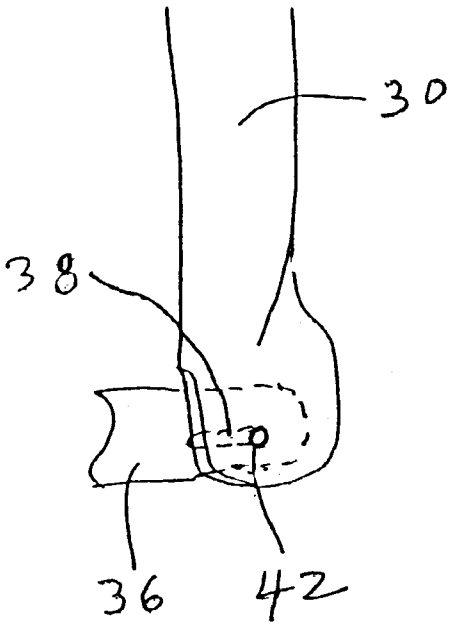
FIG. 5 is a partial detail side view of the chair in FIG. 1 showing the connection between an arm and the leg rest when the chair is in the reclining and folded positions.
Figure 4:
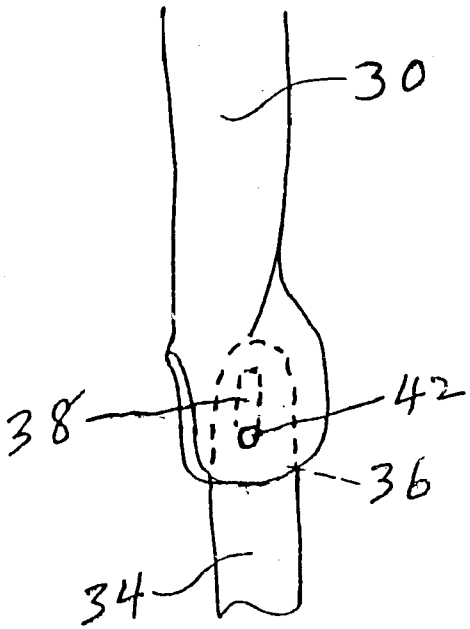
FIG. 4 is a partial detail side view of the chair shown in FIG. 1 showing the connection between an arm and the leg rest when the chair is in the rocking position.

One embodiment of a chair constructed in accordance with the present invention is shown in FIGS. 1 through 5. A rocking, reclining, folding chair 10 has parallel curved rockers 12, each of said rockers 12 having a straight extension 14 extending tangentially from the rear of the rockers 12. The rockers 12 are immovably connected to each other by one or more crossmembers 16. Front legs 22 and rear legs 26 are held on the curved rockers 12 by brackets 18, which brackets 18 are permanently secured to the rockers 12 by rivets. The legs 22 and 26 can rotate within the brackets 18. A seat frame 28 is pivotally connected to the upper ends of the legs 22 and 26 by rivets. A back frame 40 is pivotally connected to the seat frame 28 by rivets. The back frame 40 is also pivotally and movably connected to the rear aspect of the arms 30 by rivets or pins 42 which run in slots 32 cut in the arms 30. The front ends of the arms 30 are pivotally and movably connected to the upper ends 36 of the leg rest frame 34 by rivets or pins 42 which move in slots 38 in the leg rest 34. Said leg rest frame 34 is pivotally attached to the front of the seat 28. Telescoping tubes 24 with locking means 50 are attached to the seat 28 and a leg 22 maintaining the angle between them to hold the chair in a configuration for sitting and when unlocked to permit it to fold for transportation and storage.

The chair 10 is used and operated as follows: The chair 10 is shown in its rocking position in FIG. 1 and in its reclining position in FIG. 2. To move from the rocking position to the reclining position, a seated user leans forward slightly to release the pressure (caused by sitting against the back of the chair) between the pins 42 and the slots 38, lifts up on the arms 30 one inch and leans back. See FIGS. 4 and 5. Raising the arm 30 raises the pins 42 in the slots 38 unlocking the leg rest 34 and the back 30, allowing the back 30 to ease rearward pulling the leg rest 34 toward the horizontal, shifting the center of gravity of the seated user and the chair rearward, rocking the chair backward until stopped and held in the reclining position by the extension 14 of the rocker 12 coming into contact with the ground. To return to the rocking position from the reclining position, the user merely leans forward which shifts the center of gravity forward which rocks the chair 10 forward bringing the back 40 forward and lowering the leg rest 34 to the vertical, allowing the pins 42 to run down the slots 38 locking the chair into the rocking position. As the user becomes familiar with the chair 10, he or she can start the aforesaid sequence by merely moving his or her head forward to return to the erect rocking position from what has been called the "astronaut" (reclining) position, NASA as well as users of the "La-Z-Boy" type chair have found the reclining position to be most comfortable, restful and protective of the body. With a little practice, from the reclining position users can rise right out of the chair 10 on to his or her feet into a standing position, a real boon to those of us who have gotten older and have trouble getting out of a conventional chair.

In the reclining position, the extension 14 of the rocker 12 in conjunction with the triangular configuration of the seat frame 28 as one side; the back frame 40 as a second side; the arm 30 and upper end 36 of the leg rest 34 as the third side of the triangle serves to limit the backward travel or rotation of the chair 10. This limitation of rotation conveys a greater sense of security to the user than the old fashioned porch rockers which have been known to topple over backward which the present invention will not do in normal use. The rearward shifting of the center of gravity of the chair 10 and the user rockers the chair 10 to an angle of about 40 degrees between the back 40 and the horizontal. This is easily accomplished by the triangular configuration fixing or limiting the angle between the extension 14 and the back 40 at 40 degrees for the reclining position. The aforesaid triangular configuration is set and controlled by the relative distances between the points of attachment of the seat frame 28, back 40, arms 30 and upper end 36 of the leg rest 34. The actual angles (and the relative movement) are controlled by the configuration and length between attachment points of the arms 30, seat 28, back 40 and the slots 38 formed in the upper ends 36 of the leg rest 34 or by other means which can be utilized to fix and control the movement of the chair into the desired positions.

In the illustrated embodiment, this movement is dictated by the quadrilateral shape formed by the seat frame 28, the upper end 36 of the leg rest 34, the back 40 and the arm 30 when in the rocking position. (See FIG. 1.) If the seat frame 28 is considered to be the base of the trapezoid and the arms 30 are the top, the relative lengths of the sides (i.e., the upper end 36 of the leg rest 34 and the back frame 40 between the seat 28 and the arms 30) alter the angles as the relationship goes from the quadrilateral to the triangular when moved from the rocking to the reclining positions. (See FIG. 2.) As one side is longer than the other, a change of the angle which the long side bears to the base changes the angle which the short side bears to the base by, for example, a factor of two, which opens the angle between the seat and the back at the user's hip from 90 degrees to 115 degrees or 25 degrees while opening the angle at the knee between the seat and the leg rest from 90 degrees to 140 degrees or 50 degrees putting the users into the most comfortable "astronaut" position for restful reclining. There are reclining chairs on the market which are equilateral and hence the angle between seat and back is the same as the angle between the seat and the leg rest and the angle of the seat and the horizontal is unchanged. Those chairs force the user into unnatural and hence uncomfortable positions in which the user is constantly sliding downward onto the base of his or her spine instead of resting comfortably with the entire body adequately and equally supported as in the present invention.

From the rocking position, the chair 10 can be folded (see FIG. 3) for compact storage or transportation. To put the chair 10 into its folded position, the support locks 50 which hold the telescoping support tubes 24 are released and the legs 22 and 26 and the back 40 are pushed forward relative to the seat 28. Because the parts of the chair 10 are connected by a single rivet at each junction, the parts can rotate with respect to each other, thereby permitting the chair 10 to be folded.

It will be understood that the embodiment described herein is merely exemplary and that a person skilled in the art may make many variations and modifications without departing from the spirit and scope of the present invention. All such variations and modifications are intended to be included within the scope of the invention as defined in the appended claims.

What is claimed is:

1. A rocking, reclining, foldable chair, comprising:

a curved rocker or rockers having a limiting extension;

a leg or legs pivotally attached to said rocker;

a seat pivotally attached to said leg or legs;

a releasable support pivotally attached to any two of the aforesaid parts to prevent said chair from folding unexpectedly;

a back pivotally attached to said seat or leg or legs;

a pair of arms movably connected to said back; and a leg rest pivotally attached to said seat and said arms, said leg rest being movable between a rocking and a reclining position; and moving means for moving said leg rest, said back and said seat between said rocking and said reclining position.

2. A chair according to claim 1, having means for adjusting the angle which the user's back and head relate to the seat.

* * * * *